United States Patent [19]

Gano

[11] 4,413,675

[45] Nov. 8, 1983

[54] COOLING SYSTEM PROTECTIVE DEVICE

[76] Inventor: Lloyd D. Gano, 1205 Sandalwood La., Los Altos, Calif. 94022

[21] Appl. No.: 291,580

[22] Filed: Aug. 10, 1981

[51] Int. Cl.[3] ..... F28F 19/00

[52] U.S. Cl. ..... 165/119; 123/41.15; 210/315

[58] Field of Search ..... 123/41.65; 210/315; 165/119

[56] References Cited

U.S. PATENT DOCUMENTS

| | | | |
|---|---|---|---|
| 1,832,776 | 11/1931 | Hudson | 123/41.15 |
| 1,933,409 | 10/1933 | Berman | 165/119 X |
| 1,992,472 | 2/1935 | Craig | 165/119 X |
| 1,994,551 | 3/1935 | Weis . | |
| 2,095,407 | 10/1937 | Baucon et al. . | |
| 2,647,635 | 8/1953 | Hure et al. . | |
| 2,685,565 | 8/1954 | Jones et al. . | |
| 4,287,067 | 9/1981 | Dyner | 165/119 |

*Primary Examiner*—William R. Cline
*Assistant Examiner*—Theophil W. Streule
*Attorney, Agent, or Firm*—Flehr, Hohbach, Test, Albritton & Herbert

[57] ABSTRACT

A cooling system protective device placed in the direct flow from the engine to the radiator. A transparent duct with an internal screen trap, providing: full protection from particle plugging of radiator; a visual check of operation of cooling pump and thermostat; a corrosive liquid indication; and a relative flow rate indication.

9 Claims, 5 Drawing Figures

COOLING SYSTEM PROTECTIVE DEVICE

FIELD OF THE INVENTION

This invention relates to a new protective device for liquid cooling systems and more particularly to a new visual full flow monitoring device incorporating a screen trap for removing particles from the liquid. It is especially adapted for inexpensive installation in the cooling system of internal combustion engines.

The radiators of internal combustion engines often become clogged with foreign particles such as iron oxide scale or small pieces of rubber that have broken loose from various hoses. This, of course, seriously reduces the cooling capacity of the radiator and causes overheating of the system.

DESCRIPTION OF THE PRIOR ART

Cooling system devices heretofore developed have filtered only a portion of the liquid flow at a given time or have attempted to eliminate scaling through the introduction of various chemicals into the system.

The partial flow devices have a number of disadvantages. They are more expensive to install since they require special mounting provisions as well as additional hoses and fittings. In addition, foreign particles in the unfiltered portion of the cooling liquid will cause eventual clogging of the radiator. A further disadvantage is the inability of these devices to indicate total liquid flow, thereby making it difficult to quickly determine the cause of the problems that occur in the cooling system. (Reference U.S. Pat. Nos. 2,095,407; 2,647,635; 2,685,565.)

Filter devices that depend upon the introduction of chemicals for protection may reduce scaling, but will not prevent rubber or other foreign particles from circulating through the cooling system. In addition, the added chemicals may actually increase corrosion in the system. (Reference U.S. Pat. Nos. 1,994,551; 2,647,635; 2,685,565.)

SUMMARY OF THE INVENTION

The present invention is a protective device for the cooling system of an internal combustion engine. It is made up of a transparent duct with an internal screen trap. This trap consists of a screen with an aperture surrounded by a closed screen. This protective device is installed in the hose which connects the top cooling outlet of the engine to the top inlet of the radiator. To install the device, a section is cut out of the connecting hose and said device is inserted in the resulting gap and secured using hose clamps.

The entire cooling liquid flow must pass through this device before passing through the radiator. As the cooling liquid flows through the screen trap, foreign particles in the liquid enter through the aperture in the trap screen and are trapped between the closed screen and the trap screen. The openings in the screen material are small enough to remove those particles which are of sufficient size to clog the radiator tubes or passageways. Because of the surface area and gauge of mesh used in the screen trap, this invention will not appreciably restrict the flow of cooling liquid. If a large number of particles are trapped, the cooling system may indicate a tendency to overheat. In this case, a visual check of the invention will show the cause of the problem. The trap may be easily removed, cleaned and reinstalled.

The liquid in the cooling system may, at times, become corrosive in nature. Since the screen material used in this device will have the same chemical properties as the material in the radiator, any signs of corrosion on the surface of the screen trap will forewarn the possibility of corrosion in the radiator and will indicate a need to change the liquid. The screen may be wire-brushed to remove corrosion and then reused.

An important feature of this device is the ability to observe the flow of the cooling liquid through the transparent duct. As the liquid flows through the screen trap, a turbulence is created which is proportional to the rate of flow. This turbulence can be viewed directly through the transparent duct and provides a means for observing the operation of the cooling system thermostat and the cooling liquid pump.

It is an object of the present invention to provide effective protection for the radiator from particle clogging by trapping the particles so that they may be seen and removed.

It is a further object to provide a device which has a minimum number of parts, is inexpensive to purchase and simple to install. In addition, it is an object to provide a means for visual monitoring of the total liquid flow of the cooling system, the relative rate of flow, and corrosive nature of the liquid.

BRIEF DESCRIPTION OF DRAWINGS

The invention and objects and features thereof will be more readily apparent from the following description and appended claims when taken with the drawing, in which:

DESCRIPTION OF PREFERRED EMBODIMENT

Figure 1:
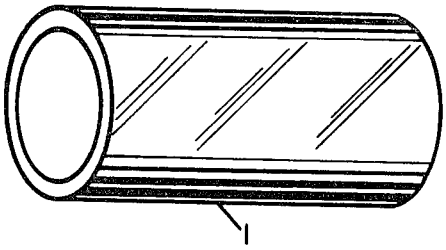
FIG. 1 is a pictorial view of the transparent duct.
Figure 2:
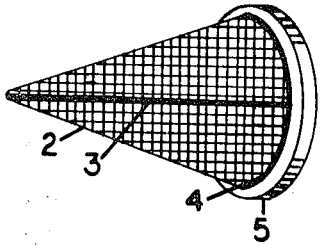
FIG. 2 is a pictorial view of the closed screen portion of the particle trap.
Figure 3:
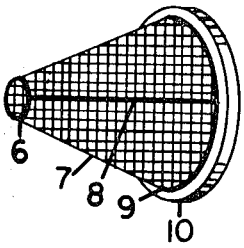
FIG. 3 is a pictorial view of the trap screen.

Referring to FIGS. 1 to 3 inclusive, the transparent duct 1 is cut from quartz glass tubing with an outside diameter equal to the inside diameter of a given cooling system top radiator hose. The wall thickness is such that it will not crack easily. Both closed screen 2 and trap screen 7 are fabricated from copper alloy wire cloth. Seam 3 of the closed screen 2 is soldered. Closed screen 2 is also soldered 4 to flange 5. The trap screen 7 is soldered at aperture 6 and seam 8. Trap screen 7 is also soldered 9 to flange 10.

The openings between the wires in the wire cloth used for fabrication of closed screen 2 and trap screen 7 are small compared to openings in the tubes or ducts of the radiator for a given cooling system. The total area of the openings in closed screen 2 is greater than the cross-sectional area inside the radiator hose. This is accomplished by elongating the screens to give them a large surface area.

Figure 4:
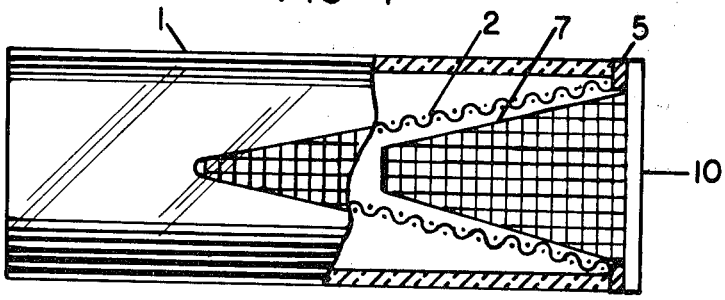
FIG. 4 is a sectional view of the assembled invention.
Figure 5:
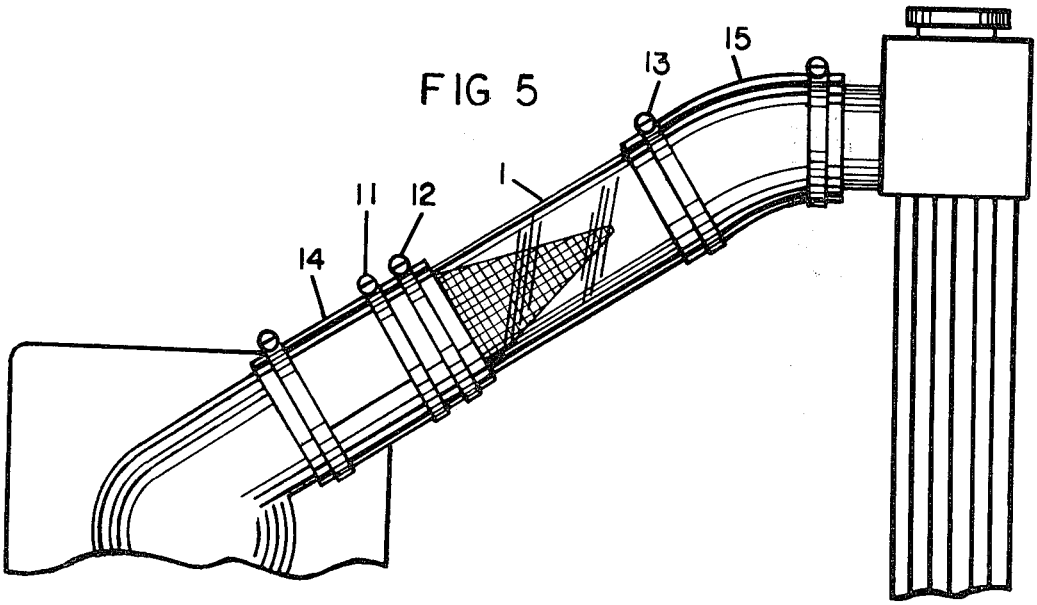
FIG. 5 is a side view of the installed invention.

Referring to FIG. 4, closed screen 2 fits into duct 1 and trap screen 7 fits into closed screen 2. They are not attanched to each other and may be easily taken apart for cleaning. The three parts of the invention are held together with the installation hose clamps as shown in FIG. 5. Flange 5 of closed screen 2 and flange 10 of trap screen 7 are held in position in hose 14 by clamp 11. The bottom end of duct 1 is sealed in hose 14 by clamp 12 and the top end is sealed in hose 15 by clamp 13.

This cooling system protective device may be altered in various ways within the basic concept of this invention. In particular, the transparent duct may be made from other suitable material such as polysulfone. The trap screens may be fabricated from materials that match the material used in the radiator for a given cooling system. For example, aluminum screen would be used for aluminum radiators. Also, spot welding may be used for fabrication of the screens. The flanges for the screens may be cast from silicone rubber or some other suitable material. Moreover, the invention could be constructed to have an access opening in the side of the transparent duct for removal and cleaning of the screen without removing hoseclamps.

Various modifications and adaptations may occur to those skilled in the art without departing from the spirit and scope of the invention as defined by the appended claims.

What is claimed is:

1. In a cooling system in which a continuous stream of coolant fluid normally flows in a given path from an engine to a radiator, a filter assembly comprising: first means including a first particle filtering screen extending across the flow path of said stream of fluid so as to prevent large particles, that is, particles of a predetermined size or larger, within said stream from passing through said screen and reaching said radiator from said engine; and second means including a second particle filtering screen extending across said flow path upstream of and spaced from said first screen for preventing said large particles from passing therethrough, said second screen including a through-hole which is sufficiently large to allow said large particles to pass therethrough but smaller in area than the cross-section of said stream, said through-hole being positioned within said stream to allow said large particles to pass into the space between said first and second screens during the normal direction of flow of said stream while preventing said large particles, once they are within said space, from readily passing back out said through-hole in the event said stream is caused to flow in the opposite direction.

2. A filter assembly according to claim 1 wherein said through-hole is approximately centrally within said stream.

3. A filter assembly according to claim 2 wherein said flow path defines an upward incline from said engine to said radiator.

4. A filter assembly according to claim 3 wherein said first filter screen is in the shape of a cone having an upstream, open base end and a downstream closed apex end and wherein said second filter screen is in the shape of a frustum having an upstream, open base end adjacent the open base end of said first filter screen and a downstream, opened apex defining said through-hole, the latter being located between the base and apex ends of said first screen means.

5. A filter assembly according to claim 4 including an elongated, light transparent sleeve disposed around and supporting said first and second screens in said stream.

6. A particle filter assembly for use in forming a part of a cooling system in which a continuous stream of coolant flows in a fixed path between an engine and a radiator, said assembly comprising a first particle filtering screen in the shape of a cone having an opened base end and a closed apex; a second filter screen in the shape of a frustum having an opened base end and an opened apex end, the latter defining a through-hole which is sufficiently large to allow particles to pass therethrough which would not otherwise pass through either one of said screens; and means for supporting said first and second screens in fixed positions relative to one another such that the base end of said second screen is located adjacent to but outside the base end of said first screen and such that the through-hole in said second screen is located concentrically within said first screen between the base and apex ends of the latter.

7. A filter assembly according to claim 6 wherein said first and second screens of the same size mesh openings.

8. A filter assembly according to claim 6 wherein said support means includes an elongated, light transparent sleeve disposed around said screens.

9. In a cooling system in which a continuous stream of coolant normally flows in a given path from an engine to a radiator, a method of filtering out large particles, that is, particles of a predetermined size or larger, from the stream, said method comprising the steps of:

positioning a first screen in said path for preventing any of said large particles within said stream from passing therethrough and reaching said radiator from said engine; and placing a second screen having a through-hole larger than said large particles within said stream upstream of said first screen so as to cause any of said large particles within said stream to pass through said through-hole and into a space between the two screens such that any particles collected therebetween are unable to flow back through said through-hole toward said engine in the event said stream reverses its flow path.

* * * * *